US005587006A

United States Patent [19]

Shepherd et al.

[11] Patent Number: 5,587,006

[45] Date of Patent: Dec. 24, 1996

[54] COMPOSITION AND PROCESS FOR MECHANICAL PLATING OF NICKEL-CONTAINING COATINGS ON METAL SUBSTRATES

[75] Inventors: Marjorie H. Shepherd, Madison, Ind.; Kim B. Gasaway, Troy, Ohio

[73] Assignee: Madison Chemical Co., Inc., Madison, Ind.

[21] Appl. No.: 510,127

[22] Filed: Aug. 1, 1995

Related U.S. Application Data

[60] Division of Ser. No. 336,668, Nov. 7, 1994, Pat. No. 5,460,848, which is a continuation-in-part of Ser. No. 224, 520, Apr. 7, 1994, abandoned.

[51] Int. Cl.[6] ..... B22F 7/00

[52] U.S. Cl. ..... 106/1.05; 106/1.22; 106/1.27; 106/286.4; 106/480

[58] Field of Search ..... 106/1.05, 1.22, 106/1.27, 286.4, 480

[56] References Cited

U.S. PATENT DOCUMENTS

| | | | |
|---|---|---|---|
| 3,013,892 | 12/1961 | Songes | 117/24 |
| 3,251,711 | 5/1966 | Pottberg et al. | 117/109 |
| 3,479,209 | 11/1969 | Clayton | 117/109 |
| 4,024,295 | 5/1977 | Chase et al. | 427/47 |
| 4,389,431 | 6/1983 | Erismann | 427/242 |
| 4,654,230 | 3/1987 | Coch | 427/242 |
| 4,800,132 | 1/1989 | Grunwald et al. | 428/560 |
| 4,832,985 | 5/1989 | Clayton | 427/242 |
| 4,849,258 | 7/1989 | Clayton | 427/242 |
| 4,868,066 | 9/1989 | Whitmore | 428/551 |
| 4,880,132 | 11/1989 | Coch et al. | 220/83 |

*Primary Examiner*—Benjamin Utech
*Attorney, Agent, or Firm*—Evenson, McKeown, Edwards & Lenahan P.L.L.C.

[57] ABSTRACT

A mechanical plating process and composition for applying tin- and nickel-containing mechanically plated coatings, which exhibit improved brightness and corrosion resistance, to metal articles.

9 Claims, No Drawings

COMPOSITION AND PROCESS FOR MECHANICAL PLATING OF NICKEL-CONTAINING COATINGS ON METAL SUBSTRATES

CROSS-REFERENCE TO RELATED APPLICATION

This application is a division of application Ser. No. 08/336,668, filed November 7, 1994, now U.S. Pat. No. 5,460,848, which in turn is a continuation-in-part of U.S. patent application Ser. No. 08/224,520, filed Apr. 7, 1994, now abandoned.

BACKGROUND OF THE INVENTION

This invention relates to a process for mechanically plating metal articles with nickel-containing coatings and to a plating composition for use in this process.

Mechanical plating is a known process for applying coatings of ductile metal to articles of iron, steel or other metals. Generally, in this process the articles to be mechanically plated are tumbled in a rotating drum in a slurry with a metal powder and an impact media, such as tiny glass beads. During the tumbling operation the impact media actually peen the metal particles onto the articles which are to be plated, so that the ductile metal particles are cold welded to the article. The slurry may also contain various dispersing agents and additives which affect the plating process.

Examples of mechanical plating are disclosed in the following U.S. patents: Songas, U.S. Pat. No. 3,013,892; Pottberg et al., U.S. Pat. No. 3,251,711; Clayton, U.S. Pat. No. 3,479,209; Coch, U.S. Pat. No. 4,654,230; Grunwald et al., U.S. Pat. No. 4,800,132; Clayton, U.S. Pat. No. 4,832,985; Clayton, U.S. Pat. No. 4,849,258; Whitmore, U.S. Pat. No. 4,868,066; and Coch et al., U.S. Pat. No. 4,880,132.

Mechanical plating has the advantages that it is less likely to result in hydrogen embrittlement of the plated articles and also that the energy costs involved in carrying out mechanical plating are generally comparatively low. Accordingly, mechanical plating has found increasing use for plating small metal articles such as screws, bolts, nails, nuts, washers, lock-rings, stampings and the like. However, known mechanical plating processes are subject to some serious limitations.

In general, successful results have only been obtained with the most ductile metals such as zinc, tin, copper, cadmium, lead, aluminum, silver or gold. Although attempts have been made to produce coatings containing less-ductile metals, such as nickel or cobalt, the results have usually been less than fully satisfactory.

Mechanically plated coatings such as zinc/cadmium or tin/cadmium provide a bright finish with good corrosion resistance. However, metals such as cadmium and lead have adverse health and environmental effects. Cadmium is a known human carcinogen, and lead is neurotoxin. Both metals persist in the environment. Therefore, it would be very desirable to be able to provide mechanically plated coatings which avoid the use of metals such as cadmium and lead and yet still show good corrosion resistance and an acceptably bright finish.

SUMMARY OF THE INVENTION

It is the object of the present invention to provide an improved process and plating composition for mechanically plating metal articles.

A particular object of the present invention is to provide an improved process and composition for mechanically plating metal articles with nickel-containing coatings.

Another object of the present invention is to provide a process for mechanically plating metal articles which exhibit improved corrosion resistance.

A further object of the present invention is to provide a process and composition for mechanically plating metal articles which can produce a desirably bright finish.

It is also an object of the present invention to provide a process and composition for mechanically plating metal articles which avoid the use of metals such as cadmium and lead.

These and other objects of the invention are achieved by providing a process for mechanically plating metal articles comprising introducing said metal articles to be mechanically plated; a quantity of impact bodies; a co-plating promoter composition comprising from 1 to 30 weight percent insoluble nickel oxide, from 5 to 50 weight percent platable tin compound, from 10 to 45 weight percent acidity regulating agent and from 10 to 60 weight percent dispersant; and sufficient water to form a slurry into a rotatable drum; then adding sufficient quantities of powdered zinc in one or more additions; rotating the drum to tumble the articles in the slurry for a period of time sufficient to apply a mechanically plated zinc-, tin- and nickel- containing coating having a desired thickness to the articles; and recovering the resulting mechanically plated articles from the slurry.

According to a further aspect of the invention, the objects of the invention are achieved by providing a plating composition for mechanically plating a tin- and nickel-containing zinc coating on metal articles wherein the composition comprises from 1 to 30 weight percent insoluble nickel oxide, from 5 to 50 weight percent tin oxide, from 10 to 45 weight percent acidity regulating agent, and from 10 to 60 weight percent dispersant.

DETAILED DESCRIPTION OF PREFERRED EMBODIMENTS

In a preferred embodiment, if the articles to be mechanically plated are contaminated by oil, grease or other contaminants which might interfere with adherence of the coating to be applied, the process of the invention begins with a cleaning treatment for removing any contaminants from the metal articles to be plated. For this purpose, the articles to be plated may be sprayed or dipped in a conventional alkaline cleaning solution for a period of time sufficient to remove the contaminants. After treatment with the alkaline solution, the articles are preferably rinsed to remove any residues of the cleaning solution. If the articles to be plated are sufficiently clean for plating, the cleaning step may be omitted.

The articles to be plated may then optionally be subjected to an acid wash or acid pickling treatment in order to remove scale. Conventional acid wash or pickling treatments may be used. After the acid treatment, it is ordinarily unnecessary to rinse the articles, since the presence of acid does not interfere with the subsequent plating steps.

Plating is facilitated if a pH of about 2 or less is maintained on the surface of the articles to be plated. Thus, the articles to be plated may further be subjected to an acid conditioning treatment to assure an acidic pH on the surface of the articles.

The articles to be plated may next be subjected to a surface preparation treatment in the form of a copper coating. Such a surface conditioning treatment typically involves treating the articles with an acidic copper solution, whereby a galvanic copper layer approximately 1 μm thick is applied to the surface of the articles. This process is typically called a copper "flash". Liquid and dry preparations are commercially available from various manufacturers for this purpose, which typically contain from 1 to 100% of an acidic copper compound such as copper sulfate. Liquid formulations normally also contain an acid such as sulfuric acid or hydrochloric acid. The amount of such a preparation which is needed to achieve a good copper "flash" depends on the amount of copper in the formulation, and proper amounts of each formulation can be selected by following manufacturer's recommendations. Dissolved copper from the acidic-water solution readily plates onto the clean metal surfaces of the parts by reacting with the surface. This is not a mechanical plating, but instead it is a type of galvanic plating.

The plating promoter composition of the present invention comprises from 1 to 30 weight percent insoluble nickel oxide, from 5 to 50 weight percent platable tin compound, from 10 to 45 weight percent acidity regulating agent, and from 10 to 60 weight percent dispersant.

The insoluble nickel oxide is preferably nickel (II) oxide. However, other platable nickel compounds, such as nickelic oxide ($Ni_2O_3$), may also be used.

The platable tin compound is preferably tin (II) oxide, which is not water or acid soluble. Alternatively particles of other platable tin compounds, such as stannous sulfate which is soluble in both water and acid, may be used as the tin compound. Stannous sulfate based promoters are less expensive than stannous oxide based promoters, but tend to give lower quality coatings.

Optionally, the promoter may additionally comprise from about 0.5 to 5 wt. percent, preferably 0.8 to 2 wt. percent, of a platable cobalt compound. Suitable platable cobalt compounds include cobalt (III) oxide, cobalt chloride, cobalt sulfate, etc. The presence of cobalt in the plated coating may serve to further increase corrosion resistance.

The promoter particles desirably have particle sizes in the range from 0.3 to 100 microns, preferably in the range from 0.5 to 80 microns. Good results have been obtained with tin oxide particles ranging from 5 to 60 microns in size, with a mean particle size of approximately 25 microns. Similarly, good results have been obtained with nickel oxide particles less than about 10 microns in size, especially particles ranging from 1 to 6 microns in size.

The plating promoter functions to promote plating of the subsequently added zinc metal powder. Zinc powders may be used having particle sizes ranging from about 1 to about 10 microns or more. A typical zinc metal powder for mechanical plating has a substantially uniform particle size of about 6 microns. The promoter co-deposits with the zinc and facilitates plating of a smooth coating. Without a promoter, zinc will plate very unevenly.

The acidity regulating agent provides a controlled acidic environment for the mechanical plating process of the invention. Suitable acidity regulating agents include alkali metal bisulfates such as sodium bisulfate ($NaHSO_4$), sodium acid pyrophosphate ($Na_2H_2P_2O_7$), citric acid, boric acid ($H_3BO_3$) and sulfamic acid. Sodium bisulfate is particularly preferred as the acidity regulating agent in the plating composition of the invention.

The plating composition of the invention further comprises from 10 to 60 weight percent dispersant. Any suitable dispersant known in the art may be utilized in the invention. A particularly preferred dispersant is hydrated amorphous silica or hydroxylated silicon dioxide. One suitable product is sold by PPG Industries under the trade name "Hi Sil 233".

Desirably, the plating composition of the invention will also contain a surfactant. Any suitable surfactant known in the art which is compatible with the other ingredients of the plating composition may be utilized. Good results have been achieved using sodium dodecylbenzene sulfonate as the surfactant. An example of a suitable surfactant is the product sold by Lido-Chem, Inc. under the trademark "Ufaryl DL-85". The amount of the surfactant may range from about 0.5 to 5 weight percent of the plating composition.

Further, the plating composition of the invention may contain an inhibitor which slows deposition of the coating and facilitates formation of a uniform coating. Suitable inhibitors include "Rodine 31A", "Rodine 95", "Rodine 102", "Rodine 103" and "Rodine 130" from Parker & AmChem; "O'B-Hibit" from O'Brien Co.; and dibutyl thiourea, which is available from many suppliers. The amount of the inhibitor may range from about 1 to about 10% of the composition.

In a particularly preferred embodiment, the plating composition of the invention further comprises an auxiliary dispersing agent. This auxiliary dispersing agent may be present in an amount from about 0.1 to about 5 weight percent. Good results have been achieved with an auxiliary dispersing agent comprising sodium lignosulfonate. An example of a suitable auxiliary dispersing agent product is sold by Daishowa Chemicals, Inc. under the trademark "Marasperse N-22".

The amount of water introduced into the rotatable drum should be just sufficient to cover the load so that a slurry is formed with the articles to be plated, the impact bodies, and the plating composition. Too much or too little water may have an adverse effect on the quality of the resulting mechanically plated coating.

If desired, the alkaline cleaning, rinsing, acid scale wash, and copper flash treatments may be carried out in the same rotating drum in which the mechanical plating is carried out. Alternatively, the steps may be carried out in separate vessels, and then the articles to be plated transferred to the rotating drum for the mechanical plating step.

The plating media or impact bodies may comprise any small dense bodies with sufficient mechanical strength and chemical inertness. It is particularly preferred to use glass beads as the impact bodies, although bodies of ceramic material can also be used. Preferably the impact bodies are spherical in form. Good results have been obtained using solid soda-lime silica glass spheres available from Madison Chemical Co., Madison, Ind. or from Potters Industries Inc., Parsippany, N.J. Typically, a mixture of different sized bodies is used to provide effective coverage of the articles to be plated. The size of the bodies will depend upon the size and shape of the article to be plated. The impact bodies should be sufficiently small that they can easily penetrate any recesses and/or cavities in the articles to be plated so that the mechanically applied coating will be deposited in the interior of any such recesses or cavities as well as on externally exposed surfaces of the articles to be plated. Generally, the impact bodies will have diameters in the range from 0.1 to 10 millimeters. One particularly useful impact medium is a mixture of glass spheres having diameters of 0.5, 2 and 4 millimeters, respectively.

The article to be plated may be formed of any platable metal. Generally, the articles to be plated are formed of ferrous metals, but other metals and metal alloys, such as brass, may also be plated if desired. The articles to be plated may be of any desired shape. Typical articles to which the invention may be applied include screws, bolts, cotter pins, deck screws, washers, nuts, nails, locking-rings, small pipe fittings, small tools, and like articles.

The articles to be plated, the impact bodies, the plating composition according to the invention and sufficient water to cover the foregoing and form a slurry are all introduced into a rotatable drum, and then the drum is rotated to tumble the slurry and allow the impact bodies to peen the coating particles onto the article to be plated.

The coating operation may generally be carried out at ambient temperatures, although it may be carried out at lower or higher temperatures, if desired.

The slurry typically has an acidic pH. Effective plating usually requires a pH of not more than 2. Good results are achieved at pH's in the range from about 1 to about 2.

The length of time the slurry will need to be tumbled will vary depending upon the nature of the article to be plated, the nature of the coating to be applied, and the conditions in the slurry. In general, the tumbling will be carried out for a period of from 10 minutes to about 10 hours, preferably about 15 minutes to about 3 hours, and particularly preferably from about 20 minutes to about 1.5 hours. In most cases, satisfactory coatings are produced when the tumbling is carried out for periods of from 30 to 45 minutes.

The coating thickness depends primarily upon the amount of coating metal in the plating composition in relation to the surface area of the articles to be plated. Coatings may effectively be applied having thicknesses ranging from 3 to more than 100 μm. Coatings having thicknesses in the range from about 3 to about 30 μm are generally referred to as mechanically plated coatings, whereas coatings having thicknesses in the range from about 25 to about 100 μm or more are generally referred to as mechanically galvanized coatings. In applying thicker coatings, it is generally desirable not to introduce all of the coating metal into the slurry at once, but instead to add it in successive portions as the tumbling proceeds. It has been found that such incremental additions tend to produce more uniform coatings.

To prevent injury to the rotating drum, the drum may be lined with a chemically-resistant, resilient material such as rubber, polypropylene, polybutylene, or the like.

The rotational speed of the barrels in which the mechanical plating is carried out is usually expressed in terms of surface feet per minute (sfpm). The drum may be rotated at peripheral speeds ranging from about 140 to 250 sfpm at a typical tilt angle of approximately 30 degrees from horizontal. In general, larger diameter drums will rotate at slower rpm.

Coatings are applied to the parts by the addition of powdered zinc into the slurry containing the tin- and nickel-containing promoter of the invention. The addition of zinc particles to the promoter-containing slurry begins a co-plating process whereby a zinc/tin/nickel alloy coating is attached to the surface of the parts.

After the desired coating has been applied, the slurry is withdrawn from the rotating drum and the plated articles are separated from the impact bodies using conventional separating devices such as magnetic separators, vibratory screens, etc. The water from the slurry is depleted in chemical constituents and may be re-used or discharged to a waste treatment facility.

If desired, the plated articles may be subjected to a known chromate sealing treatment by treating them with a chromate solution.

Further details of the invention will become apparent from the following examples which are intended merely as illustrations of the invention and should not be considered limiting.

EXAMPLES

EXAMPLE 1

Steel washers were subjected to alkaline cleaning, rinsed and then contacted with an acidic pickling solution in order to remove scale. The washers and a mixture of glass beads 0.5 and 2 millimeters in diameter were introduced into a rubber-lined rotatable drum together with sufficient water to cover the load and form a slurry. An acidic copper compound (e.g. copper sulfate) was then introduced to the slurry, and the drum was rotated to deposit a minute amount of copper on the washers. The drum was then rotated and a co-plating promoter composition comprising 8 weight percent nickel (II) oxide, 22 weight percent stannous (II) oxide, 22.7 weight percent sodium bisulfate, 40 weight percent "Hi Sil 233" dispersant, 2 weight percent "UFARYL DL-85" surfactant, 4.3 weight percent "Rodine 130" inhibitor and 1 weight percent "Marasperse N-22" dispersing agent was introduced into the slurry. Zinc powdered metal was introduced into the slurry in three successive portions at 10 minute intervals. The slurry was tumbled for a total of 35 to 40 minutes, after which it was withdrawn from the rotatable drum, and the washers were separated-from the glass beads and the liquid solution. The washers were found to be co-plated with a substantially uniform zinc-, tin- and nickel-containing coating approximately 15 μm thick.

The resultant coating was smooth, uniform and far brighter than conventional mechanically plated parts. In salt spray tests conducted in accordance with ASTM B-117, the coating was found to give significantly improved corrosion resistance.

EXAMPLE 2

Iron nails were treated with an alkaline cleaning solution to remove grease and soil, rinsed and then treated with an acid pickling solution to remove scale. The nails were then introduced into a rubber-lined rotatable drum together with a mixture of glass beads 1 millimeter and 3 millimeters in diameter and sufficient water to cover the load and form a slurry. An acidic copper compound (e.g. copper sulfate) was then introduced into the slurry, and the drum was rotated to deposit a minute amount of copper on the nails. Thereafter, a co-plating promoter composition comprising 12.5 weight percent nickel (II) oxide, 37.5 weight percent stannous (II) oxide, 23.4 weight percent sodium disulfate, 20 weight percent "Hi Sil 233" dispersant, 2 weight percent "Ufaryl DL-85" surfactant, 3.6 weight percent "Rodine 130" inhibitor, and 1.0 weight percent "Marasperse N-22" dispersing agent was introduced into the slurry. Zinc powdered metal was introduced into the slurry in four successive portions at 6 minute intervals. The slurry was tumbled for a total of 30 minutes, after which it was withdrawn from the rotatable drum, and the nails were separated from the glass beads and the liquid solution. The nails were found to have been plated with a substantially uniform tin- and nickel-containing zinc coating between 35 and 40 μm thick. The coated nails were then sealed by treatment with a chromate solution.

The resultant coating was smooth, uniform and far brighter than typical mechanically coated parts. In salt spray tests conducted in accordance with ASTM B-117, the coating was again found to give significantly improved corrosion resistance.

EXPERIMENTAL PROCEDURE

EXAMPLES 3 TO 29 AND COMPARATIVE EXAMPLES C-1 TO C-9:

Parts to be plated were weighed and introduced into a 3 cubic foot plating barrel. The surface area of the parts was calculated, and the result was used to determine the amounts of additives needed for each run. Warm water was added to the barrel to a level that just covered the parts, and rotation of the barrel was begun.

Optionally, if the parts were too dirty for immediate plating, from 4 to 8 ounces of an alkaline cleaner (Madison Chemical Co. "MCC-173") were added per 100 $ft^2$ of part surface area, and the barrel was rotated until visual inspection of the parts indicated that they were sufficiently clean for plating. Typically 10 to 15 minutes of alkaline cleaning was adequate. The alkaline cleaning solution was then discharged from the plating barrel, and the parts were rinsed until the pH was neutral again.

If initial inspection of the parts indicated that they were already sufficiently clean for immediate plating, the alkaline cleaning step was omitted.

A small amount of water (typically approximately one gallon), from ¼ to ⅓ of the impact media required for the subsequent plating, and approximately 17 fluid ounces of an acid cleaner (Madison Chemical Co., "MCC-273") per 100 $ft^2$ of part surface area were added, and the resulting slurry was tumbled for about 10 minutes to remove heat treatment scale, rust and any residual oils. The barrel was then stopped, the acid cleaner was discharged, and the barrel was rinsed to completely remove the acid cleaner, while care was taken to avoid any loss of the parts or impact media.

Sufficient water was then added to cover the parts together with the remaining ⅔ to ¾ of the impact media and the barrel was rotated again. An acid conditioner was also added which lowers the pH to less than 2 at which effective plating can occur and which contains surfactants to help disperse the metal powders when they are introduced. In a typical run approximately 17 fluid ounces of acid conditioner (Madison Chemical Co., "MCC-270E") were used per 100 $ft^2$ of calculated part surface area. After addition of the acid conditioner, tumbling was continued for from 2 to 10 minutes.

Next, a material was added which provided a copper "flash" on the parts to be plated. In the following examples either a liquid copper "flash" material (Madison Chemical Co. "MCC-280") or a powdered copper "flash" material (Madison Chemical Co. "MCC-277") was used for each run. Tumbling was continued for from 5 to 10 minutes to allow the copper to cover the surface of the parts.

Then the promoter of the invent ion was added, and tumbling was continued for a few minutes (usually 1 to 2 minutes) to allow the promoter to disperse throughout the slurry. Added amounts of promoter were based on the calculated surface area of the parts to be mechanically plated and ranged from 1.8 ounces to 6.4 ounces per 100 $ft^2$ of part surface area.

After the promoter had dispersed throughout the slurry, additions of zinc powder were begun. The zinc powder was added in portions to produce a more uniform plating on all surfaces. The first addition of zinc powder (referred to in the art as a "zinc flash") is typically much smaller than the subsequent additions of zinc. In the following tests about 0.08 ounces of zinc powder were typically added as the "zinc flash". After the "zinc flash" had been given 2 or 3 minutes to plate, the remainder of the zinc powder was added. To obtain a more even plating, the zinc powder was divided into from 3 to 10 portions introduced at intervals of from 5 to 10 minutes. After the last addition of zinc powder, tumbling was continued for at least 10 minutes to allow as much zinc as possible to mechanically plate onto the parts. Sample parts were periodically withdrawn from the barrel in order to check the plating thickness, and the tumbling was continued until the desired coating thickness was obtained.

After the desired plating thickness had been attained, the barrel was slowed and additional water was added to dilute the slurry. The barrel was then stopped and the parts were rinsed out of the barrel and separated from the impact media using magnets. If desired, the plated parts were treated to apply final coating such as a chromate conversion coating, and the parts were subsequently dried.

In the following tests, the alkaline cleaner was a mixture comprising 55 parts sodium carbonate, 40 parts sodium metasilicate, 3 parts sodium soap of rosin and rosin fatty acids and 2 parts of an ethoxylated alcohol surfactant sold by Madison Chemical Company, Madison, Ind. under the trademark "MCC-173". The acid cleaner was Madison Chemical Company "MCC-273", a mixture comprising 48.8 parts sulfuric acid, 0.1 part tetrasodium EDTA, 4.5 parts nonylphenoxypolyethoxyethanol, 0.3 parts sodium salt of alkylated naphthalene sulfonate, 0.3 parts sodium salt of naphthalenesulfonic acid and 46 parts water. The acid conditioner was a mixture comprising 51.43 parts sulfuric acid, 2 parts 2-butoxyethanol, 1.5 parts gluconic acid, 0.25 parts sodium dodecylbenzene sulfonate, 0.25 parts sodium lignosulfonate, 2.2 parts nonylphenoxypolyethoxyethanol and 42.38 parts water sold by Madison Chemical Company, Madison, Ind. under the trademark "MCC-270E". The copper flash additive was either a liquid copper conditioning agent sold by Madison Chemical Company, Madison, Ind. under the trademark "MCC-280" comprising 34.9 parts sulfuric acid, 5 parts hydrogen chloride, 7.5 parts copper sulfate and 52.6 parts water, or a powdered copper conditioning agent sold by the same company under the trademark "MCC-277" comprising powdered copper sulfate. The impact media used in all of the following tests was a 50/50 mixture of "MCC-100" and "MCC-105" solid soda-lime silica glass spheres.

Corrosion resistance, as measured by time in a salt spray to red rust, was tested both without (w/o) subsequent chromate treatment and with (w/) subsequent chromate treatment. Chromate treatment was effected using a chromate conversion solution sold by Madison Chemical Company, Madison, Indiana under the trademark "MCC-3980" comprising 15 parts chromic acid, 13 parts acetic acid, 8.66 parts nitric acid, 1.59 parts hydrogen chloride, 2 parts sulfuric acid and 59.75 parts water.

The following comparison and promoter compositions according to the invention were used in the examples:

Promoter Comp-1

30 parts stannous (II) oxide (SnO)

22.7 parts sodium bisulfate ($NaHSO_4$)

40 parts hydroxylated silicon dioxide 2 parts sodium dodecylbenzene sulfonate "Ufaryl DL-85"

4.3 parts inhibitor "Rodine 130"

1 part sodium lignosulfonate "Marasperse N-22"

Promoter Comp-2

32 parts stannous (II) oxide (SnO)

41.4 parts sodium bisulfate ($NaHSO_4$)
20 parts hydroxylated silicon dioxide
2 parts sodium dodecylbenzene sulfonate "Ufaryl DL-85"
3.6 parts inhibitor "Rodine 130"
1 part sodium lignosulfonate "Marasperse N-22"

Promoter Ni-1
8 parts nickel (II) oxide (NiO)
22 parts stannous (II) oxide (SnO)
22.7 parts sodium bisulfate ($NaHSO_4$)
40 parts hydroxylated silicon dioxide
2 parts sodium dodecylbenzene sulfonate "Ufaryl DL-85"
4.3 parts inhibitor "Rodine 130"
1 part sodium lignosulfonate "Marasperse N-22"

Promoter Ni-2
8 parts nickelic oxide ($Ni_2O_3$)
22 parts stannous (II) oxide (SnO)
22.7 parts sodium bisulfate ($NaHSO_4$)
40 parts hydroxylated silicon dioxide
2 parts sodium dodecylbenzene sulfonate "Ufaryl DL-85"
4.3 parts inhibitor "Rodine 130"
1 part sodium lignosulfonate "Marasperse N-22"

Promoter Ni-3
12.5 parts nickel (II) oxide (NiO)
37.5 parts stannous (II) oxide (SnO)
23.4 parts sodium bisulfate ($NaHSO_4$)
20 parts hydroxylated silicon dioxide
2 parts sodium dodecylbenzene sulfonate "Ufaryl DL-85"
3.6 parts inhibitor "Rodine 130"
1 part sodium lignosulfonate "Marasperse N-22"

Promoter Ni-4
12.5 parts nickelic oxide ($Ni_2O_3$)
37.5 parts stannous (II) oxide (SnO)
23.4 parts sodium bisulfate ($NaHSO_4$)
20 parts hydroxylated silicon dioxide
2 parts sodium dodecylbenzene sulfonate "Ufaryl DL-85"
3.6 parts inhibitor "Rodine 130"
1 part sodium lignosulfonate "Marasperse N-22"

Promoter Ni-5
8 parts nickel (II) oxide (NiO)
1 part cobaltous chloride ($CoCl_2$)
22 parts stannous (II) oxide (SnO)
22.7 parts sodium bisulfate ($NaHSO_4$)
40 parts hydroxylated silicon dioxide
2 parts sodium dodecylbenzene sulfonate "Ufaryl DL-85"
4.3 parts inhibitor "Rodine 130"
1 part sodium lignosulfonate "Marasperse N-22"

Promoter Ni-6
8 parts nickel (II) oxide (NiO)
1 part cobaltous sulfate ($CoSO_4$)
22 parts stannous (II) oxide (SnO)
22.7 parts sodium bisulfate ($NaHSO_4$)
40 parts hydroxylated silicon dioxide
2 parts sodium dodecylbenzene sulfonate "Ufaryl DL-85"
4.3 parts inhibitor "Rodine 130"
1 part sodium lignosulfonate "Marasperse N-22"

Promoter Ni-7
8 parts nickel (II) oxide (NiO)
22 parts stannous (II) oxide (SnO)
22.7 parts sodium acid pyrophosphate ($Na_2H_2P_2O_7$)
40 parts hydroxylated silicon dioxide
2 parts sodium dodecylbenzene sulfonate "Ufaryl DL-85"
4.3 parts inhibitor "Rodine 130"
1 part sodium lignosulfonate "Marasperse N-22"

Promoter Ni-8
8 parts nickel (II) oxide (NiO)
22 parts stannous (II) oxide (SnO)
22.7 parts citric acid
40 parts hydroxylated silicon dioxide
2 parts sodium dodecylbenzene sulfonate "Ufaryl DL-85"
4.3 parts inhibitor "Rodine 130"
1 part sodium lignosulfonate "Marasperse N-22"

Promoter Ni-9
8 parts nickel (II) oxide (NiO)
22 parts stannous (II) oxide (SnO)
22.7 parts boric acid
40 parts hydroxylated silicon dioxide
2 parts sodium dodecylbenzene sulfonate "Ufaryl DL-85"
4.3 parts inhibitor "Rodine 130"
1 part sodium lignosulfonate "Marasperse N-22"

Promoter Ni-10
8 parts nickel (II) oxide (NiO)
22 parts stannous (II) oxide (SnO)
22.7 parts sulfamic acid ($SO_2NH_2OH$)
40 parts hydroxylated silicon dioxide
2 parts sodium dodecylbenzene sulfonate "Ufaryl DL-85"
4.3 parts inhibitor "Rodine 130"
1 part sodium lignosulfonate "Marasperse N-22"

Promoter Ni-11
41 parts nickel (II) oxide (NiO)
22 parts stannous (II) oxide (SnO)
22.7 parts sodium bisulfate ($NaHSO_4$)
40 parts hydroxylated silicon dioxide
2 parts sodium dodecylbenzene sulfonate "Ufaryl DL-85"
4.3 parts inhibitor "Rodine 130"
1 part sodium lignosulfonate "Marasperse N-22"

Promoter Ni-12
16 parts nickel (II) oxide (NiO)
22 parts stannous (II) oxide (SnO)
22.7 parts sodium bisulfate ($NaHSO_4$)
40 parts hydroxylated silicon dioxide
2 parts sodium dodecylbenzene sulfonate "Ufaryl DL-85"
4.3 parts inhibitor "Rodine 130"
1 part sodium lignosulfonate "Marasperse N-22"

Promoter Ni-13
8 parts nickel (II) oxide (NiO)
8 parts nickelic oxide ($Ni_2O_3$)
22 parts stannous (II) oxide (SnO)
22.7 parts sodium bisulfate ($NaHSO_4$)
40 parts hydroxylated silicon dioxide
2 parts sodium dodecylbenzene sulfonate "Ufaryl DL-85"
4.3 parts inhibitor "Rodine 130"
1 part sodium lignosulfonate "Marasperse N-22"

Promoter Ni-14
16 parts nickelic oxide ($Ni_2O_3$)
22 parts stannous (II) oxide (SnO)
22.7 parts sodium bisulfate ($Na_2HSO_4$)

40 parts hydroxylated silicon dioxide
2 parts sodium dodecylbenzene sulfonate "Ufaryl DL-85"
4.3 parts inhibitor "Rodine 130"
1 part sodium lignosulfonate "Marasperse N-22"

Promoter Ni-15
9 parts nickel (II) oxide (NiO)
16 parts stannous (II) oxide (SnO)
23 parts sodium sulfate
35 parts hydroxylated silicon dioxide
2 parts sodium dodecylbenzene sulfonate "Ufaryl DL-85"
3 parts inhibitor "Rodine 102"
2 part sodium lignosulfonate "Marasperse N-22"

| Example | Alkaline Cleaner | Acid Cleaner | Acid Conditioner | Copper Flash | | Zinc Additions | Plated Thickness | Salt Spray Test (hours) | |
|---|---|---|---|---|---|---|---|---|---|
| No. | (ounces) | (ounces) | (ounces) | (ounces) | Promoter | (no. × wt.) | (mils) | w/o chromate | w/ chromate |
| 3 | 8 oz. | 16 oz. | 1 fl. oz. | MCC-280 1 fl. oz. | Ni-1 (0.11 oz.) | 1 @ 0.09 oz. 5 @ 0.48 oz. | 0.65 mils | 116 hrs. | 430 hrs. |
| 4 | 8 oz. | 16 oz. | 1 fl. oz. | MCC-280 1 fl. oz. | Ni-2 (0.48 oz.) | 1 @ 0.09 oz. 5 @ 0.48 oz. | 0.31 mils | 116 hrs. | 620 hrs. |
| 5 | 8 oz. | 16 oz. | 2 oz. | MCC-280 2 oz. | Ni-3 (0.1 oz.) | 1 @ 0.1 oz. 10 @ 0.63 oz. | 2.74 mils | 500 hrs. | 840 hrs. |
| 6 | — | 16 oz. | 2 oz. | MCC-280 2 oz. | Ni-4 (0.1 oz.) | 1 @ 0.1 oz. 10 @ 0.63 oz. | 2.47 mils | 360 hrs. | 840 hrs. |
| 7 | — | 16 oz. | 1 oz. | MCC-280 1 oz. | Ni-1 (0.1 oz.) | 1 @ 0.08 oz. 3 @ 0.53 oz.* | 0.37 mils | 85 hrs. | 360 hrs. |
| 8 | 8 oz. | 8 oz. | 1 oz. | MCC-280 1 oz. | Ni-5 (0.09 oz.) | 1 @ 0.08 oz. 3 @ 0.53 oz. | 0.38 mils | 85 hrs. | 504 hrs. |
| 9 | 8 oz. | 8 oz. | 1 oz. | MCC-280 1 oz. | Ni-6 (0.09 oz.) | 1 @ 0.08 oz. 3 @ 0.53 oz. | 0.35 mils | 85 hrs. | 600 hrs. |
| 10 | 8 oz. | 8 oz. | 1 oz. | MCC-280 1 oz. | Ni-7 (0.09 oz.) | 1 @ 0.08 oz. 3 @ 0.53 oz. | 0.29 mils | 168 hrs. | 240 hrs. |
| 11 | 8 oz. | 8 oz. | 1 oz. | MCC-280 1 oz. | Ni-8 (0.09 oz.) | 1 @ 0.08 oz. 3 @ 0.53 oz. | 0.34 mils | 168 hrs. | 240 hrs. |
| 12 | 8 oz. | 8 oz. | 1 oz. | MCC-280 1 oz. | Ni-9 (0.09 oz.) | 1 @ 0.08 oz. 3 @ 0.53 oz. | 0.34 mils | 168 hrs. | 192 hrs. |
| 13 | 8 oz. | 8 oz. | 1 oz. | MCC-280 1 oz. | Ni-10 (0.09 oz.) | 1 @ 0.08 oz. 3 @ 0.53 oz. | 0.29 mils | 168 hrs. | 192 hrs. |
| 14 | 8 oz. | 8 oz. | 1 oz. | MCC-280 1 oz. | Ni-11 (0.09 oz.) | 1 @ 0.08 oz. 3 @ 0.53 oz. | 0.32 mils | 168 hrs. | 240 hrs. |
| 15 | 8 oz. | 8 oz. | 1 oz. | MCC-277 0.15 oz. | Ni-1 (0.18 oz.) | 1 @ 0.08 oz. 3 @ 0.53 oz. | 1.08 mils | 264 hrs. | 432 hrs. |
| 16 | 8 oz. | 8 oz. | 1 oz. | MCC-277 0.15 oz. | Ni-2 (0.18 oz.) | 1 @ 0.08 oz. 3 @ 0.53 oz. | 0.73 mils | 192 hrs. | 432 hrs |
| 17 | 8 oz. | 8 oz. | 1 oz. | MCC-277 0.15 oz. | Ni-5 (0.18 oz.) | 1 @ 0.08 oz. 3 @ 0.53 oz. | 1.11 mils | 265 hrs. | 360 hrs. |
| 18 | 8 oz. | 8 oz. | 1 oz. | MCC-277 0.15 oz. | Ni-6 (0.18 oz.) | 1 @ 0.08 oz. 3 @ 0.53 oz. | 0.79 mils | 290 hrs. | 600 hrs. |
| 19 | 8 oz. | 8 oz. | 1 oz. | MCC-277 0.15 oz. | Ni-11 (0.18 oz.) | 1 @ 0.08 oz. 3 @ 0.53 oz. | 0.72 mils | 168 hrs. | 265 hrs. |
| 20 | 8 oz. | 8 oz. | 1 oz. | MCC-277 0.15 oz. | Ni-7 (0.18 oz.) | 1 @ 0.08 oz. 3 @ 0.53 oz. | 0.94 mils | 168 hrs. | 360 hrs. |
| 21 | 8 oz. | 8 oz. | 1 oz. | MCC-277 0.15 oz. | Ni-B (0.18 oz.) | 1 @ 0.08 oz. 3 @ 0.53 oz. | 0.87 mils | 168 hrs. | 335 hrs. |
| 22 | 8 oz. | 8 oz. | 1 oz. | MCC-277 0.15 oz. | Ni-9 (0.18 oz.) | 1 @ 0.08 oz. 3 @ 0.53 oz. | 0.97 mils | 192 hrs. | 335 hrs. |
| 23 | 8 oz. | 8 oz. | 1 oz. | MCC-277 0.15 oz. | Ni-10 (0.18 oz.) | 1 @ 0.08 oz. 3 @ 0.53 oz. | 1.07 mils | 168 hrs. | 360 hrs. |
| 24 | — | — | 1 oz. | MCC-280 1 oz. | Ni-2 (0.09 oz.) | 1 @ 0.08 oz. 3 @ 0.53 oz. | 0.06 mils | 96 hrs. | 120 hrs. |
| 25 | — | — | 1 oz. | MCC-280 1 oz. | Ni-2 (0.18 oz.) | 1 @ 0.08 oz. 3 @ 0.53 oz. | 0.21 mils | 96 hrs. | 192 hrs. |
| 26 | — | — | 1 oz. | MCC-280 1 oz. | Ni-12 (0.09 oz.) | 1 @ 0.08 oz. 3 @ 0.53 oz. | 0.61 mils | 96 hrs. | 480 hrs. |
| 27 | — | — | 1 oz. | MCC-280 1 oz. | Ni-13 (0.09 oz.) | 1 @ 0.08 oz. 3 @ 0.53 oz. | 0.40 mils | 96 hrs. | 265 hrs. |
| 28 | — | — | 1 oz. | MCC-280 1 oz. | Ni-14 (0.09 oz.) | 1 @ 0.08 oz. 3 @ 0.53 oz. | 0.60 mils | 96 hrs. | 480 hrs. |
| 29 | — | — | 1 oz. | MCC-280 1 oz. | Ni-2 (0.09 oz.) | 1 @ 0.08 oz. 3 @ 0.53 oz. | 0.60 mils | 96 hrs. | 265 hrs. |
| 30 | 4 oz. | 4 oz. | 1 oz. | MCC-280 0.135 oz. | Ni-15 (0.1 oz.) | 1 @ 0.0675 oz. 3 @ 0.3 oz. | 0.39 mils | 48 hrs. | 312 hrs. |
| C1 | 8 oz. | 16 oz. | 1 fl. oz. | MCC-280 1 fl. oz. | Comp-1 (0.11 oz.) | 1 @ 0.09 oz. 5 @ 0.48 oz. | 0.64 mils | 116 hrs. | 430 hrs. |
| C2 | 8 oz. | 16 oz. | 1 fl. oz. | MCC-280 1 fl. oz. | Comp-1 (0.48 oz.) | 1 @ 0.09 oz. 5 @ 0.48 oz. | 0.32 mils | 92 hrs. | 360 hrs. |
| C3 | 8 oz. | 16 oz. | 1 fl. oz. | MCC-280 2 oz. | Comp-2 (0.1 oz.) | 1 @ 0.1 oz. 10 @ 0.63 oz. | 3.05 mils | 288 hrs. | 600 hrs. |
| C4 | — | 16 oz. | 1 fl. oz. | MCC-280 1 oz. | Comp-1 (0.1 oz.) | 1 @ 0.08 oz. 3 @ 0.53 oz.* | 0.47 mils | 85 hrs. | 312 hrs. |
| C5 | 8 oz. | 8 oz. | 1 oz. | MCC-280 1.oz. | Comp-1 (0.09 oz.) | 1 @ 0.08 oz. 3 @ 0.53 oz. | 0.41 mils | 85 hrs. | 620 hrs. |

-continued

| Example No. | Alkaline Cleaner (ounces) | Acid Cleaner (ounces) | Acid Conditioner (ounces) | Copper Flash (ounces) | Promoter | Zinc Additions (no. × wt.) | Plated Thickness (mils) | Salt Spray Test (hours) w/o chromate | Salt Spray Test (hours) w/ chromate |
|---|---|---|---|---|---|---|---|---|---|
| C6 | 8 oz. | 8 oz. | 1 oz. | MCC-280 1 oz. | Comp-1 (0.09 oz.) | 1 @ 0.08 oz. 3 @ 0.53 oz. | 0.30 mils | 168 hrs. | 240 hrs. |
| C7 | 8 oz. | 8 oz. | 1 oz. | MCC-277 0.15 oz. | Comp-1 (0.18 oz.) | 1 @ 0.08 oz. 3 @ 0.53 oz. | 1.01 mils | 265 hrs. | 432 hrs. |
| C8 | — | — | 1 oz. | MCC-280 1 oz. | Comp-1 (0.09 oz.) | 1 @ 0.08 oz. 3 @ 0.53 oz. | 0.68 mils | 96 hrs. | 265 hrs. |
| C9 | — | — | 1 oz. | MCC-280 0.1 oz. | Comp-1 (0.18 oz.) | 1 @ 0.08 oz. 3 @ 0.53 oz. | 0.23 mils | 96 hrs. | 265 hrs. |
| C10 | 4 oz. | 4 oz. | 1 oz. | MCC-280 0.135 oz. | Comp-1 (0.1 oz.) | 1 @ 0.0675 oz. 3 @ 0.48 oz. | 0.75 mils | 48 hrs. | 144 hrs. |

EXAMPLE 31

An assortment of metal parts was cleaned in an alkaline cleaner (MCC-173@8 oz/100 $ft^2$) for 10 minutes. A glass bead impact medium was introduced, and the cleaned parts were subjected to a descaling/conditioning treatment with an acid cleaner (MCC-275@17 oz/100 $ft^2$) for 5 minutes. Subsequently, the parts were tumbled with a powdered copper "flash" material (MCC-277@3 oz/100 $ft^2$) for 5 minutes, after which promoter Ni-15 was added (1.5 oz/100 $ft^2$) and tumbling was continued for 3 minutes to disperse the promoter throughout the slurry. Zinc powder was then added in four portions; the first portion being added at a rate of 1.5 oz/100 $ft^2$ and the subsequent three portions being added at a rate of 0.4 oz/100 $ft^2$, and after each addition of zinc powder the slurry was tumbled for 5 minutes. The resulting plated parts had good brightness and corrosion resistance.

Analysis of plated coatings:

To demonstrate the co-deposition of nickel in the plated coatings produced with the promoters of the present invention, sample coatings were stripped off with a water/hydrochloric acid mixture and the resulting solutions were analyzed for their zinc, tin and nickel content. The results are set forth in the following table:

| Sample No. | Promoter | Solution Zinc Content (ppm) | Solution Tin Content (ppm) | Solution Nickel Content (ppm) |
|---|---|---|---|---|
| Control | Conventional Sn only | 2200 | 17.0 | 0.13 |
| Sample 1 | #1 Sn & Ni | 2400 | 20.0 | 0.18 |
| Sample 3 | #3 Sn + Ni | 5500 | 24.0 | 0.35 |

The foregoing description and examples have been set forth merely to illustrate the invention and are not intended to be limiting. Since modifications of the described embodiments incorporating the spirit and substance of the invention may occur to persons skilled in the art, the invention should be construed broadly to embrace all variations falling within the scope of the appended claims and equivalents.

What is claimed is:

1. A co-plating promoter composition for mechanically plating a tin- and nickel-containing coating on metal articles, said composition comprising from 1 to 30 wt-% insoluble nickel oxide, from 5 to 50 wt-% platable tin compound, from 10 to 45 wt-% acidity regulating agent and from 10 to 60 wt-% dispersant.

2. A co-plating promoter composition according to claim 1, wherein said dispersant comprises a hydrated amorphous silica dispersant.

3. A co-plating promoter composition according to claim 1, wherein said acidity regulating agent is selected from the group consisting of alkali metal bisulfates, alkali metal acid pyrophosphates, citric acid, boric acid and sulfamic acid.

4. A co-plating promoter composition according to claim 3, wherein said acidity regulating agent is sodium bisulfate.

5. A co-plating promoter composition according to claim 1, comprising 8 wt-% nickel (II) oxide, 22 wt-% tin (II) oxide, 22.7 wt-% sodium bisulfate, 40-wt-% hydrated amorphous silica dispersant, 2 wt-% surfactant, 4.3 wt-% inhibitor, and 1 wt-% auxiliary dispersing agent.

6. A co-plating promoter composition according to claim 1, comprising 12.5 wt-% nickel (II) oxide, 37.5 wt-% tin (II) oxide, 23.4 wt-% sodium bisulfate, 20 wt-% hydrated amorphous silica dispersant, 2 wt-% surfactant, 3.6 wt-% inhibitor, and 1 wt-% auxiliary dispersing agent.

7. A co-plating promoter composition according to claim 1, wherein said insoluble nickel oxide is nickel (II) oxide and said platable tin compound is tin (II) oxide.

8. A co-plating promoter composition according to claim 1, wherein said insoluble nickel oxide is selected from the group consisting of nickel (II) oxide and nickelic oxide.

9. A co-plating promoter composition according to claim 8, wherein said insoluble nickel oxide is nickel (II) oxide.

* * * * *